United States Patent [19]

Hammons

[11] Patent Number: 4,756,472

[45] Date of Patent: Jul. 12, 1988

[54] MAIL DELIVERY SIGNALING FLAG

[76] Inventor: George M. Hammons, Rte. 6, Box 215, Dandridge, Tenn. 37725

[21] Appl. No.: 88,070

[22] Filed: Aug. 21, 1987

[51] Int. Cl.[4] ..... A47G 29/12

[52] U.S. Cl. ..... 232/35; 232/34

[58] Field of Search ..... 232/35, 34, 17

[56] References Cited

U.S. PATENT DOCUMENTS

| | | | |
|---|---|---|---|
| 2,804,262 | 8/1957 | Mancuso | 232/35 |
| 2,927,727 | 3/1960 | Kreider | 232/35 |
| 2,988,268 | 6/1961 | Mioduski | 232/35 |
| 3,168,239 | 2/1965 | Cooper | 232/35 |
| 3,589,329 | 6/1971 | Schuh | 116/132 |
| 3,602,424 | 8/1971 | Raulston | 232/35 |
| 3,747,839 | 7/1973 | Morton | 232/35 |
| 4,066,209 | 1/1978 | Brake | 232/35 |
| 4,186,870 | 2/1980 | Walden | 232/35 |
| 4,190,193 | 2/1980 | Smith | 232/35 |
| 4,365,740 | 12/1982 | Whitley et al. | 232/35 |
| 4,552,302 | 11/1985 | Rung | 232/35 |

*Primary Examiner*—Robert W. Gibson, Jr.

*Attorney, Agent, or Firm*—Luedeka, Hodges & Neely

[57] ABSTRACT

The specification discloses a mail delivery signaling flag for use on a rural mailbox including an elongate indicator arm. The indicator arm has a weighted end and a flagged end and is rotatably mounted to the side of the mailbox. A trigger means holds the indicator arm in a generally horizontal position until the mailbox door is opened, at which time the indicator arm assumes a generally vertical position with the flagged end raised to indicate that a mail carrier has opened the box.

7 Claims, 1 Drawing Sheet

MAIL DELIVERY SIGNALING FLAG

BACKGROUND

The present invention relates to rural mailboxes and more particularly to a signaling device for indicating that mail has been deposited in the mailbox.

Incoming and outgoing mail for the typical rural and suburban household is picked up from and delivery by the U.S. Postal Service from a so-called "rural" mailbox. The mail carrier covers a route which often encompasses a considerable network of roads; therfore, the carrier only stops when he must deposit incoming mail or when he is signaled to pick up outgoing mail. The normal rural mailbox comes equipped with a flag which is raised to signal the carrier of outgoing mail. The carrier generally lowers the flag when he picks up outgoing mail, but no similar signaling flag is generally provided to signal the dweller of incoming mail.

On those days when the household receives but sends no mail, the recipient must either watch for the carrier, wait until after the latest likely delivery time, or pace to and from the mailbox. Since the typical rural mailbox is usually situated on the road for access by the carrier, and the dwelling is often offset from the road, it would be advantageous for the recipient to avoid unnecessary trips to the mailbox through heat, cold, rain, snow and the like. A suitable mail delivery signaling flag could eliminate many of these unnecessary trips by signaling the rural dweller that the mail carrier has opened the mailbox door.

A mail delivery signaling device which is suitable for the rural environment must solve several problems. One problem is presented by the fact that the rural dwelling is often situated a considerable distance from the mailbox. A suitable signaling device must be easily visible from a distance and from a variety of viewpoints.

Another problem stems from the fact that the mailbox is positioned along a roadway. The mailbox is usually mounted atop a post and cannot easily be sheltered. Therefore, any signaling flag mounted on the mailbox is constantly exposed to the elements. Springs or intricate working parts rapidly corrode under such conditions, rendering any signaling flag useless which employs such components.

Finally, and of utmost importance, is the problem of time. As previously mentioned, a rural mail carrier must often cover a large territory. He is usally unable, and otherwise unwilling, to invest seconds at each box to set a signaling flag. Therefore, a mail delivery signaling flag should automatically operate when the mail carrier opens the door to deposti mail. Also, the device should be easily reset so that even a child who is sent for the mail can reset the indicator. Such ease of resetting would also encourage the mail carrier to reset the signaling flag on those occasions when he picks up outgoing mail be leaves no incoming mail.

While indicator flags for signaling the delivery of mail are known, most of these are unduly complicated, not easily visible from a distance, or require the active participation of the mail carrier for proper signaling.

It is accordingly object of the invention is to provide a mail delivery signaling flag which will automatically operate when the mail carrier opens the mailbox. door, yet avoids the use of springs or intricate working parts.

Another an object of the invention to provide a mail delivery signaling flag which can easily be seen from a considerable distance and from a variety of viewpoints.

Yet another object of the invention is to provide a mail delivery signaling device at a low cost.

SUMMARY OF THE INVENTION

In accordance with the invention, there is provided a mail delivery signaling flag for use on a side wall of a rural mailbox having a downwardly opening front door. The device includes an elongate indicator arm having a weighted end and a flagged end and being rotatably mounted on the side wall of the mailbox between the weighted and flagged ends. The weighted end has sufficient mass in relation to the flagged end to cause the indicator flag to be normally disposed in a generally vertical position. The flagged end is configured to be visible from a distance when the indicator arm is vertical. The device further includes trigger means to support the weighted end of the indicator arm with the indicator arm being disposed in a somewhat horizontal position along the side wall of the mailbox. The trigger means is operative to release the weighted end of the indicator arm when the mailbox door is opened to allow the indicator arm to assume its normally vertical disposition.

In one preferred embodiment of the invention, the trigger means is a trigger arm which is pivotally movable when the door is closed to permit the indicator arm to be moved into the somewhat horizontal position and which releases the indicator arm when the mailbox door is opened. In another preferred embodiment of the invention, the trigger is a magnet capable of holding the indicator arm in the somewhat horizontal position and which releases the indicator arm when the mailbox door is opened.

DETAILED DESCRIPTION

Figure 1:
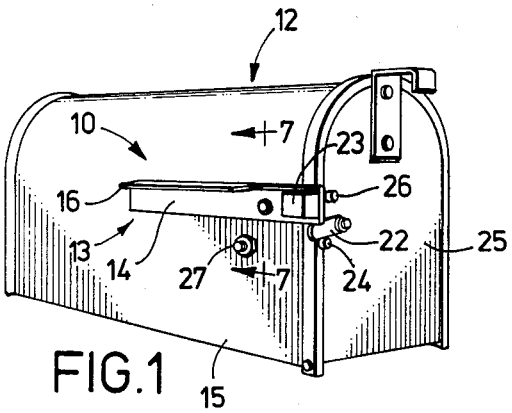
FIGS. 1–4 are a series of perspective views of a mailbox together with a first embodiment of a mail delivery signaling flag according to the invention which illustrate the operation thereof.
Figure 2:
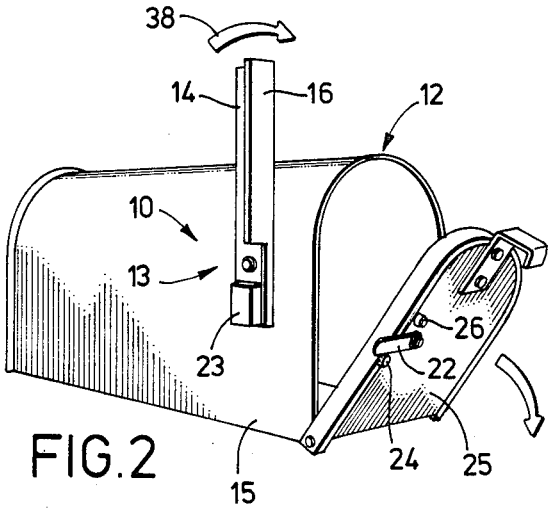
Figure 3:
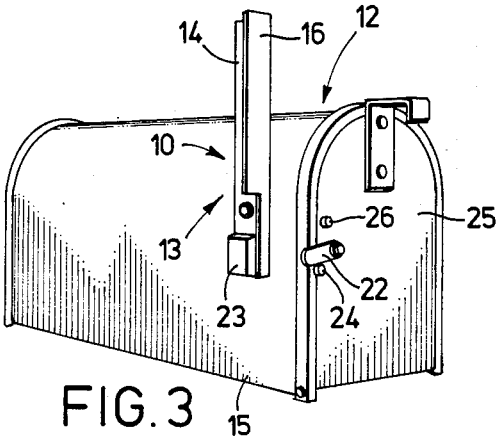

Referring now to the drawings in which like reference characters refer to the same or similar parts throughout the several views, there is shown in FIGS. 1–4 one embodiment of a mail delivery signaling flag 10 attached to a rural mailbox 12. The flag 10 includes an indicator arm 13 which operates to indicate the delivery of mail. The preferred indicator arm 13 is visible when in a raised position as shown in FIGS. 2 and 3 from a variety of viewpoints. This is accomplished by forming the arm from sheet metal which is folded at a generally right angle to provide an elongate rectangular parallel blade 14 and an elongate rectangular perpendicular fin 16. Preferaby, part of the perpendicular blade is cut away so that it does not extend with its entire width along the parallel blade although a smaller width of the perpendicular blade 14 extends along the parallel blade 16 for reinforcement. The indicator arm is suitably fabricated from an aluminum alloy with the width of the parallel blade 14 being between about 1–1½ inches and the width of the perpendicular blade 16 being between about 1½–3 inches. The preferred arm 13 has a length of between about 10 and about 14 inches.

Figure 7:
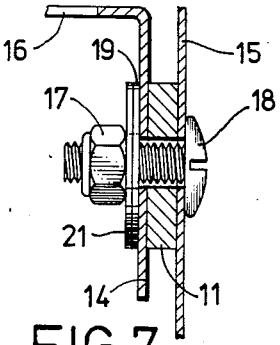
FIG. 7 is an enlarged cross-sectional view of the pivotal connection mechanism of the mail delivery signaling flag of FIG. 1 taken along line 7—7.
Figure 8:
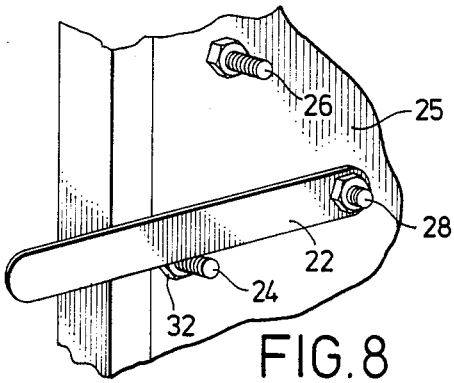
FIG. 8 is an enlarged partial perspective view of the trigger mechanism employed in the mail delivery signaling flag of FIG. 1.

Referring to FIG. 7 in conjunction with FIGS. 1–4, the indicator arm 10 is rotatably mounted on the mailbox 12 along an upper portion of a mailbox side wall 15, preferably by a non-corroding bolt 18, e.g., a stainless steel bolt. As shown in FIG. 7, the bolt 18 has an enlarged head and extends through the wall 15 the mailbox 12 to the outside. A hole is formed in the parallel blade 14 of the indicator arm with the diameter of the hole being slightly greater than the diameter of the bolt 18 to allow the indicator arm 10 to rotate freely upon the bolt 18. A spacer 11 is positioned upon the bolt 18 between the parallel blade 14 and the mailbox wall 15 to maintain the indicator arm 13 in a spaced-apart relationship to the wall 15 so that the free rotation of the indicator arm 10 is not hindered by contacting the wall. A suitable thickness of the spacer 11 is about ⅛–¼ inch and has a diameter of about ¾ inch. Preferably, the spacer is formed from a material having natural lubrication properties such as lead or plastic and most preferably is threaded to fix the bolt in a stationary perpendicular position with respect to the wall 15. The pivot bolt 18 extends through the hole in indicator arm 13 and two washers 19 and 21 are placed on the bolt 18. A suitable diameter for washers 19 and 21 is about ¾ inch. Washer 19 is preferably made of plastic and contacts the parallel fin 14 to provide a smooth sliding surface and washer 21 is a rigid washer, for example, a non-corroding metal washer. A nut 17 with integral locknut feature is placed onto the pivot bolt 18 and is only tightened sufficiently that the parallel fin 14 of the arm 13 is held in a parallel relationship with respect to the wall but the arm 13 is free to pivot about the pivot bolt 18 in a plane generally parallel to the mailbox side wall 5. A stop 27 is provided on the wall 15 to prevent the indicator arm from traveling past the generally vertical position. The stop 27 is suitably provided by a bolt extending from inside the box secured with a nut. When the mailbox 12 is mounted on a block of wood, a suitable stop 27 can be provided by without making a hole in the wall 15 by employing a screw or nail which is anchored in the wood block at a suitable position. It is necessary for the weighted end of indicator arm 13 to be sufficiently long that it extends below the mailbox wall to contact the stop.

Referring still to FIGS. 1–4, it is shown that a weight 23 is attached to the parallel blade 14 on the end opposite the perpendicular fin 16. Preferably the weight 12 is a generally rectangular lead weight attached by non-corroding fasteners such as aluminum or stainless steel rivots. The weight 12 has sufficient mass to counterbalance the flagged end of the indicator arm 13 so that when allowed to rotate freely about the bolt 18, the indicator arm 13 will assume a normally vertical position in relation to the mailbox 12 with the perpendicular fin 16 disposed vertically above the weight 12. With the indicator arm 10 thus disposed, the parallel blade 14 will appear as a rectangular plate when viewed from beside the mailbox 12, and the perpendicular fin 16 will appear as a rectangular plate when viewed from generally in front or generally behind the mailbox 12.

Referring to FIGS. 1–4 and FIG. 6, the indicator flag 10 in the preferred embodiment depicted includes a mechanism trigger 20 employing a trigger arm 22 which is rotatably mounted on the mailbox door 25 by an arm pivot bolt 28. Preferably the trigger arm 22 is an elongate rectangular strip cut from sheet metal stock and has a hole near one end. The arm pivot bolt 28 extends generally perpendicularly through the mailbox door 25 away from the mailbox 12. A first nut (not shown) secures the arm pivot bolt 28 to the mailbox door 12. The trigger arm 22 is placed upon the arm pivot bolt 28 so that the bolt extends generally perpendicularly through the hole in the trigger arm 22. The hole is dimensioned to allow the trigger arm 22 to rotate freely about the arm pivot bolt 28. A second nut, preferably a nut with an integral locknut, is threaded onto the arm pivot bolt 28 so that trigger arm 22 lies between the first and second nuts and the first and second nuts are separated by a distance of about but greater than the thickness of the trigger arm 22 to allow free rotation. The length of the trigger arm 22 is sufficient to allow the trigger arm to extend a short distance past the mailbox side wall 15 and intercept rotation of the indicator arm 10 when the trigger arm 22 is disposed generally perpendicular to the side wall 5.

Further reference to FIGS. 1–4 and FIG. 6 shows that a support stop 24 extends through the mailbox door 3 and away from the mailbox 2. The support stop 24 is threaded and is secured to the mailbox door 3 by a nut 32. The support stop 24 extends generally perpendicularly away from the mailbox door 25 a sufficient distance to intercept the rotation of the trigger arm 22. Preferably, the support stop 24 is positioned generally between the arm pivot bolt 28 and the perimeter of the mailbox door 25 toward the mailbox wall 15 so that when rotated counterclockwise the trigger arm 22 will engage and rest upon the support stop 24, and thereby be disposed in a generally horizontal position generally perpendicular to the mailbox side wall 15. In the preferred embodiment a limiting stop 26 is fastened to the mailbox door 25 in the same manner as the support stop 24 in such position on the mailbox door to prevent clockwise rotation of the trigger arm 22 past nearly vertical, so that the weight of the trigger arm creates a bias toward the support stop 24 and will return to the horizontal position.

Figure 4:
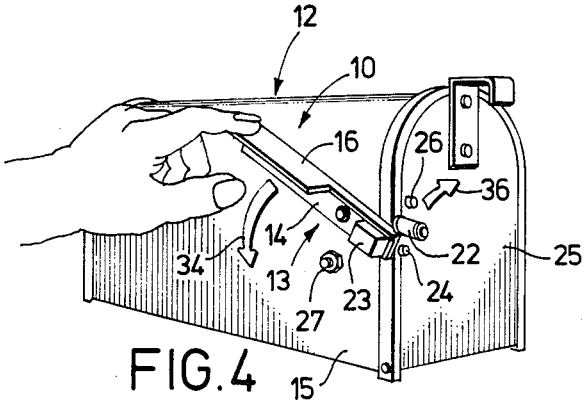

Referring to FIGS. 1–4 the interaction of the indicator arm 13 and trigger arm 22 can be shown. As mentioned earlier, the weight 23 serves to dispose the indicator arm 10 in a normally vertical position in relation to the mailbox 2. The rural dweller who expects mail may prepare the signaling flag by rotating the flagged end of the indicator arm 10 downwardly as shown in FIG. 4 in the direction indicated by arrow 34. The weighted end of the indicator arm 10 engages and pushes the end of the trigger arm 22 away as shown by arrow 36. The trigger arm is of such length that at some point before the trigger arm engages the limiting stop 26 the indicator arm passes the trigger arm, and the trigger arm 22 falls to again engage and rest upon the support stop 24. When released, the weighted end of the indicator arm 10 rotates downwardly but is intercepted by the trigger arm 22. The indicator arm 10 is held in a generally horizontal position by the trigger arm 22 until the mailbox door is opened, at which time the weighted end of the indicator arm 10 falls downwardly and the flagged end moves upwardly as indicated by arrow 38 as shown in FIG. 2 to dispose the signaling flag in a normal vertical position. The considerate mailcarrier, who picks up mail but wishes to inform the dweller that he left none, may easily rotate the indicator arm 13 to reset the signaling flag to a horizontal position after he has closed the mailbox door 25.

Figure 5:
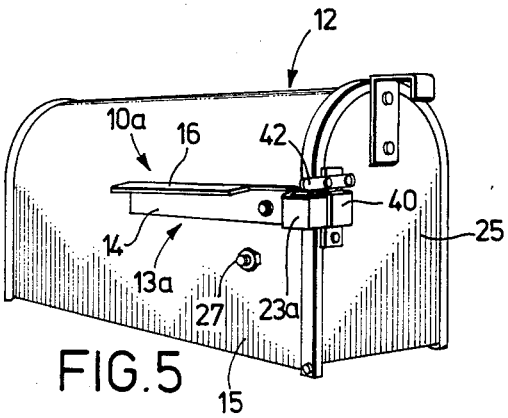
FIGS. 5–6 are perspective views of a mailbox together with a second embodiment of a mail delivery signaling flag according to the invention which illustrate the operation thereof.
Figure 6:
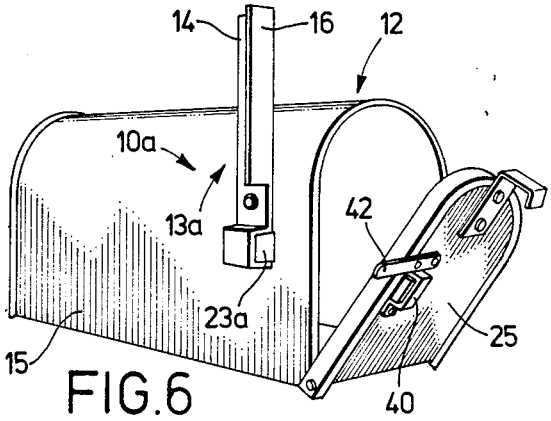

Referring now to FIGS. 5 and 6, another preferred embodiment of the present invention is designated as mail delivery signaling flag 10*a*. Signaling flag 10*a* includes a similar indicator arm 13*a* and mounting mechanism. However, the trigger means is a magnet 40 mounted on the mailbox door 25 and magnetically attracted material on the weighted end of the indicator arm 13*a*. Preferably, a steel weight 23*a* is employed to fulfill the dual role of providing weight for the indicator arm 13*a* and being capable of being attached to the magnet 40. As illustrated, the steel weight 23*a* is attached to the arm 13*a* so that it has an exposed portion facing towards the magnet 40 on the door 25. The magnet can be suitably provided by a cabinet latch-type magnet attached to the door with bolts, rivets, or other such fasteners. In the preferred embodiment depicted, a stop arm 42 is provided on the door 25 above the magnet 40 to prevent excessive travel of the arm during resetting. As illustrated in FIG. 6, the signaling device 10*a* operates when the door 25 is opened with the magnet 40 releasing the arm 13*a* and allowing it to move to the upright position when the door is opened. The flag 10*a* is reset similarly to flag 10 by rotating it to the generally horizontal position whereupon the magnet 40 will engage the steel weight 23*a* to secure and support the arm.

The mail delivery signaling flag in accordance with the present invention provides an inexpensive and mechanically simple signaling device for signaling dwellers of rural and suburban households that mail has been delivered. If desired, the entire apparatus can be constructed of non-corroding materials which will be extremely resistant to damage by the elements. Since the operation of the device is so simple, the arm 13 can be reset with one hand even by a child. For ease of installation, templates can be provided for proper positioning of the holes to be drilled in the mailbox and "do-it-yourself" installation can be accomplished in a manner of minutes.

The configuration of the preferred indicator arm provides that the flagged end of the arm 13 can be seen from a variety of view points. If desired, depending on the position of the house in relation to the mailbox, portions of the flagged end can be painted with a highly visible paint which, due to the operation of the flag, will be easily visible only when the arm assumes the normally vertical position indicating the delivery of mail.

While the invention has been described in terms of preferred embodiments, it is to be understood that nothing in the above description is intended to limit the scope of the claims and it is contemplated that numerous changes and modifications can be made without departing from the spirit of the invention.

What is claimed is:

1. A mail delivery signaling flag for use on a side wall of a rural mailbox, the mailbox having a downwardly opening front door, said signaling device comprising:

an elongate indicator arm having a flagged end and a weighted end and being pivotally mounted at a pivot point between said flagged end and said weighted end upon the side wall of the mailbox, said weighted end having sufficient mass in relation to said flagged end to cause said indicator flag to be normally disposed in a generally vertical position with said flagged end being above said weighted end, said flagged end being configured to be visible from a distance when said indicator arm is disposed generally vertically and above said weighted end; and trigger means for supporting the weighted end of said indicator arm with said indicator arm in a somewhat horizontal position along the side wall of the mailbox, said trigger means being operative to release the weighted end of said indicator arm when the mailbox door is opened, thereby allowing said indicator arm to assume its normally vertical disposition, wherein said trigger means comprises:

a support stop fastened to the front door; and a trigger arm pivotally mounted on the front door, said trigger arm being adapted to be contacted by said indicator arm and having a free end which is upwardly movable in response to forces exerted by said indicator arm to yieldably permit travel of said indicator arm from the normally vertical to the somewhat horizontal position, said trigger arm being further adapted to prevent the reverse travel of said indicator arm to the normally vertical position when said door is closed by said support stop contacting said trigger arm and preventing downward movement of said free end of said trigger arm.

2. The mail delivery signaling flag of claim 1, wherein said trigger means further comprises a limiting stop fastened to the front door for preventing excessive travel of said trigger arm in response to movement of said indicator arm.

3. The signaling flag of claim 1 wherein, said flagged end is formed by a parallel blade and a perpendicular fin, said parallel blade configured as a rectangular plate when viewed from beside the mailbox, said perpendicular fin configured as a rectangular plate when viewed in its normally vertical disposition from generally in front of the mailbox.

4. A mail delivery signaling flag for use on a side wall of a rural mailbox, the mailbox having a downwardly opening front door, said signaling device comprising:

an elongate indicator arm having a flagged end and a weighted end and being pivotally mounted at a pivot point between said flagged end and said weighted end upon the side wall of the mailbox, said weighted end having sufficient mass in relation to said flagged end to cause said indicator flag to be normally disposed in a generally vertical position with said flagged end being above said weighted end, said flagged end being configured to be visible from a distance when said indicator arm is disposed generally vertically and above said weighted end; and trigger means for supporting the weighted end of said indicator arm with said indicator arm in a somewhat horizontal position along the side wall of the mailbox, said trigger means being operative to release the weighted end of said indicator arm when the mailbox door is opened, thereby allowing said indicator arm to assume its normally vertical disposition, wherein said trigger means comprises a magent attached to said door and magnetically attracted material attached to said indicator arm to secure said indicator arm in the somewhat horizontal position.

5. A mail delivery signaling flag for use on one side of a rural mailbox, the mailbox having a downwardly opening front door, said signaling device comprising:

an elongate indicator arm having a flagged end and a weighted end being rotatably mounted on the side wall of the mailbox from a point between said flagged end and said weighted end, said flagged end further comprising a parallel fin configured as a highly visible rectangular plate when viewed from the side of the mailbox and a perpendicular fin configured as a highly visible rectangular plate when viewed in its normally vertical position from generally in front of or generally behind the mailbox, said weighted end being of sufficient mass to normally dispose said indicator arm generally vertically in relation to the mailbox, said flagged end being thereby disposed generally vertically above said weighted end;

a support stop fastened to the front door;

a trigger arm rotatably mounted on the front door, said trigger arm being responsive to forces exerted by said indicator arm to yieldably permit travel of said indicator arm from a normally vertical position and supporting the arm in a somewhat horizontal position, said trigger arm preventing reverse travel of said indicator arm to a normally vertical position by engaging both said support stop and said indicator arm, and a limiting stop fastened to the front door for prevent excessive travel of said trigger arm in response to movement of said indicator arm.

6. A mail delivery signaling flag for use on one side of a rural mailbox, the mailbox having a downwardly opening front door, said signaling device comprising:

an elongate indicator arm having a flagged end and a weighted end being rotatably mounted on the side wall of the mailbox from a point between said flagged end and said weighted end, said flagged end further comprising a parallel fin configured as a highly visible rectangular plate when viewed from the side of the mailbox and a perpendicular fin configured as a highly visible rectangular plate when viewed in its normally vertical position from generally in front of or generally behind the mailbox, said weighted end being of sufficient mass to normally dispose said indicator arm generally vertically in relation to the mailbox, said flagged end being thereby disposed generally vertically above said weighted end;

a magnet mounted on the front door and a magnetically attracted material being provided on said weighted end of said flag, said magnetically attracted material serving to add weight to said weighted end to cause said weighted end to dispose said indicator arm in a generally vertical position and securing said weighted end of said indicator arm to said magnet when said arm is moved to the generally vertical position.

7. The mail delivery signaling flag of claim 6 further comprising a stop arm on said mailbox door which prevents said weighted end of said indicator arm from moving past the magnet when the indicator arm is moved into the generally horizontal position.

* * * * *